US008851096B2

(12) United States Patent
De Villenfagne De Sorinnes et al.

(10) Patent No.: US 8,851,096 B2
(45) Date of Patent: Oct. 7, 2014

(54) COLLAPSIBLE LATTICE BEAM, TRUSS AND CONSTRUCTION INCLUDING SUCH A BEAM

(75) Inventors: Derek De Villenfagne De Sorinnes, Brussels (BE); André Fritz, Beinheim (FR); Michel Hinker, Brumath (FR)

(73) Assignee: Crescential, Brussels (BE)

( * ) Notice: Subject to any disclaimer, the term of this patent is extended or adjusted under 35 U.S.C. 154(b) by 197 days.

(21) Appl. No.: 13/500,786

(22) PCT Filed: Oct. 6, 2010 (Under 37 CFR 1.47)

(86) PCT No.: PCT/FR2010/052108

§ 371 (c)(1), (2), (4) Date: Dec. 7, 2012

(87) PCT Pub. No.: WO2011/051587

PCT Pub. Date: May 5, 2011

(65) Prior Publication Data

US 2014/0076370 A1 Mar. 20, 2014

(30) Foreign Application Priority Data

Oct. 9, 2009 (FR) ..... 09 57088

(51) Int. Cl.

| | |
|---|---|
| ***E04C 3/02*** | (2006.01) |
| ***E04H 15/44*** | (2006.01) |
| ***E04C 3/08*** | (2006.01) |
| ***E04C 3/00*** | (2006.01) |
| ***E04H 15/64*** | (2006.01) |
| ***E04H 15/18*** | (2006.01) |
| *E04C 3/04* | (2006.01) |

(52) U.S. Cl.

CPC *E04C 3/02* (2013.01); *E04H 15/44* (2013.01); *E04C 3/08* (2013.01); *E04C 3/005* (2013.01); *E04H 15/642* (2013.01); *E04H 15/18* (2013.01); *E04C 2003/0491* (2013.01)

USPC ..... 135/122; 52/641

(58) Field of Classification Search

CPC ..... E04C 2003/0491; E04C 3/005

USPC ..... 135/122, 908; 52/641, 645, 646, 693

See application file for complete search history.

(56) References Cited

U.S. PATENT DOCUMENTS 2,513,729 A * 7/1950 Lemen ..... 135/122
2,828,756 A * 4/1958 Worley ..... 135/97

(Continued)

FOREIGN PATENT DOCUMENTS

DE 8230404 12/1982
FR 806218 12/1936

(Continued)

OTHER PUBLICATIONS

European Patent Office International Search Report dated Feb. 16, 2011, International Application No. PCT/FR2010/052108 (3 pages).

*Primary Examiner* — Noah Chandler Hawk
(74) *Attorney, Agent, or Firm* — McCracken & Frank LLC

(57) ABSTRACT

A preassembled lattice beam formed by a lower rib and an upper rib interconnected by at least one diagonal attached such as to be able to pivot between a transport position and a mounting position, said beam having at least one stationary upright connecting the lower and upper ribs at a right angle in said mounting position.

13 Claims, 4 Drawing Sheets

(56) References Cited

U.S. PATENT DOCUMENTS

| | | | | | |
|---|---|---|---|---|---|
| 4,089,148 | A | * | 5/1978 | Oehmsen et al. | 52/693 |
| 4,262,460 | A | | 4/1981 | Bertin | |
| 4,546,591 | A | | 10/1985 | Beltz | |
| 4,604,844 | A | * | 8/1986 | Mikulas et al. | 52/632 |
| 5,269,106 | A | * | 12/1993 | Stafford et al. | 52/63 |
| 5,819,492 | A | * | 10/1998 | Konicek | 52/641 |
| 6,082,385 | A | * | 7/2000 | Burford et al. | 135/122 |
| 7,849,639 | B2 | * | 12/2010 | Sprung | 52/82 |

FOREIGN PATENT DOCUMENTS

| | | |
|---|---|---|
| FR | 2422791 | 11/1979 |
| WO | 92/14016 | 8/1992 |
| WO | 2006/047864 | 5/2006 |

* cited by examiner

COLLAPSIBLE LATTICE BEAM, TRUSS AND CONSTRUCTION INCLUDING SUCH A BEAM

The present invention relates to the field of the construction of tent structures, stretched cloth structures, and similar structures, in particular the field of pre-mounted or preassembled structures intended to be mounted or assembled on-site after transport of the preassembled component elements, generally by truck, boat, etc. These structures in particular have the advantage of being quicker and easier to mount, being less expensive, and being able, if necessary, to be disassembled after use to be remounted elsewhere or at another time, for example in the context of a periodic event. Furthermore, the component elements used to assemble such structures such as beams, lattice joists, etc., are often standardized elements thus allowing a certain configurability, for example for extension or enlargement work. Still more precisely, the present invention relates to the field of lattice beams that can be used for the construction of this type of structure or similar types of structures.

Tents or stretched fabric structures are generally made up either of disassemblable light construction assemblies using fabrics or canvas sheets stretched over a disassemblable infrastructure, or in the form of heavy construction assemblies, the supporting elements of which are sealed in the ground and often integrated to the covering.

Disassemblable light construction assemblies most often make it possible to meet temporary covering needs, such as for patios or temporary shelters.

The problem in particular then arises of the transport of the preassembled elements to the assembly site. In fact, in the constructions known to date, the different component elements were either delivered in a state disassembled enough to make it possible to best fill the volume of the transport vehicle, or delivered in a more advanced assembly state, but then with more significant lost volume due to the bulk of the preassembled pieces. In the first case, the on-site assembly time is obviously increased accordingly, whereas in the second case, the transport costs are most often higher.

The present invention aims to offset these drawbacks by proposing a preassembled lattice beam for building tent or similar structures having the same, or even better, technical performance in terms of structural characteristics, while allowing a reduced bulk during transport to the assembly site as well as easier and shorter implementation during assembly of the structure relative to the assembly of similar, non-preassembled elements.

To that end, the present invention relates to a preassembled lattice beam for the construction of a truss for a roof of a structure, in particular such as a tent or a stretched fabric structure, characterized in that it is essentially made up of a lower rib and an upper rib connected to one another by at least one diagonal secured to said lower and upper ribs so as to be able to pivot, between the transport position in which the lower and upper ribs are dose together, preferably in direct contact with one another, and a mounting position in which said lower and upper ribs are spaced apart from each other, preferably so as to form an acute angle, preferably of approximately 30°, between the at least one diagonal and at least one of the two ribs, and in that it has at least one stationary upright connecting the lower and upper ribs at a right angle in said assembly position.

It also relates to a roof truss for a structure such as a tent or stretched fabric structure, characterized in that it comprises a plurality of preassembled lattice beams according to the invention assembled to one another, in particular by pins.

Lastly, the present invention also relates to a structure such as a tent or a stretched fabric structure, characterized in that it comprises a truss according to the invention, placed and assembled on posts, in particular by pins, the assembly potentially being stabilized by brackets assembled on said posts and lattice.

The invention will be better understood using the following description, in reference to one preferred embodiment, provided as a non-limiting example, and explained in reference to the appended diagrammatic drawings, in which.

Figure 3A:
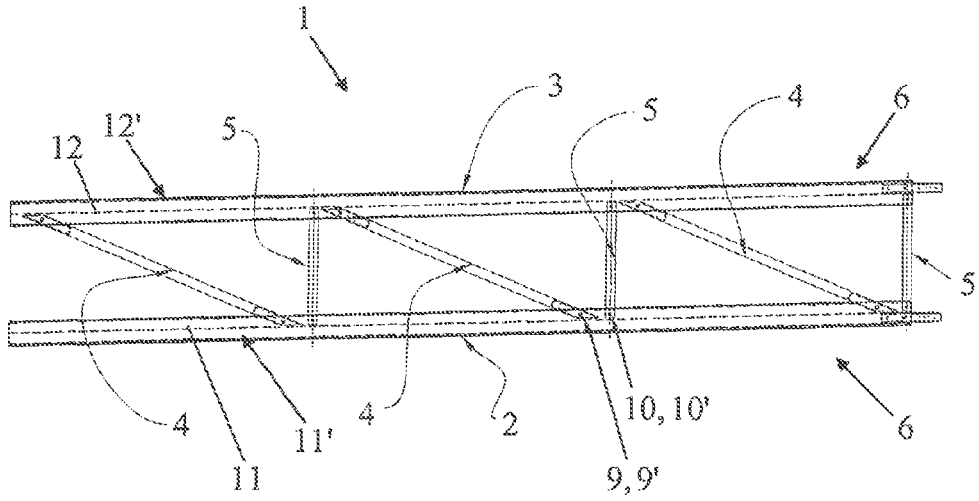
Figure 3B:
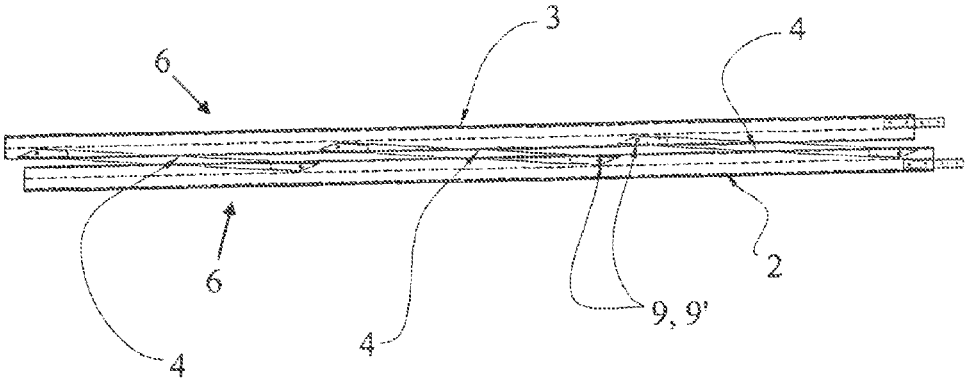
Figure 4:
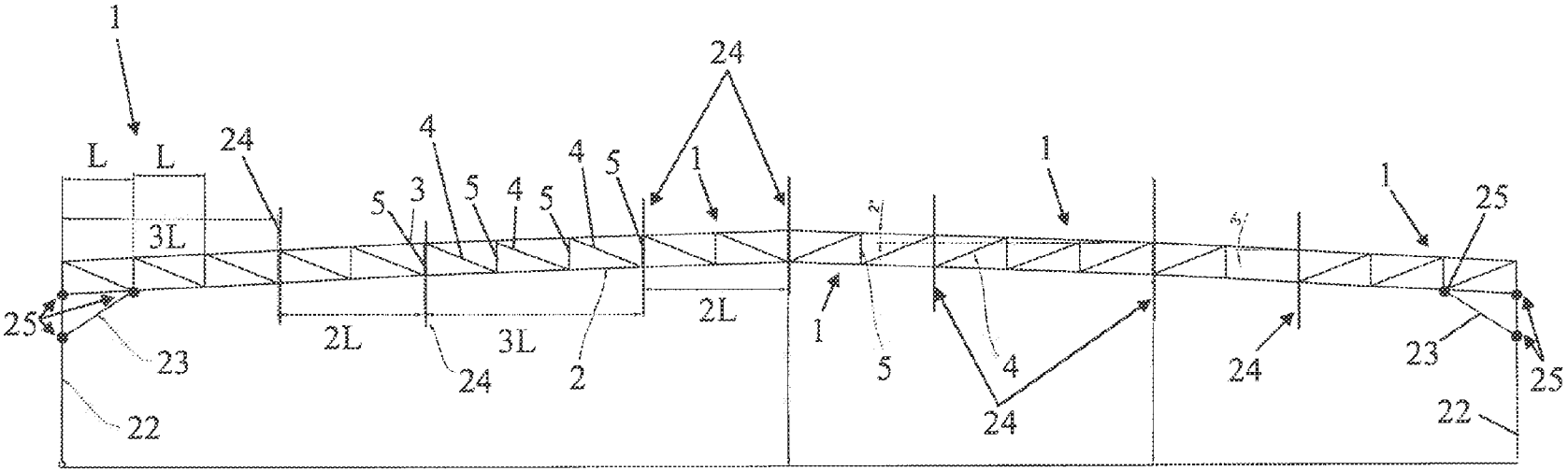

FIG. 3*a* is a diagrammatic side view of the beam according to the invention in longitudinal cross-section along the median axis in the mounting mode;

FIG. 3*b* is a diagrammatic side view of the beam according to FIG. 3*a* in the folded transport mode;

FIG. 4 is a diagrammatic cross-sectional side view of a structure mounted using several beams according to the invention assembled to one another.

Figure 1:
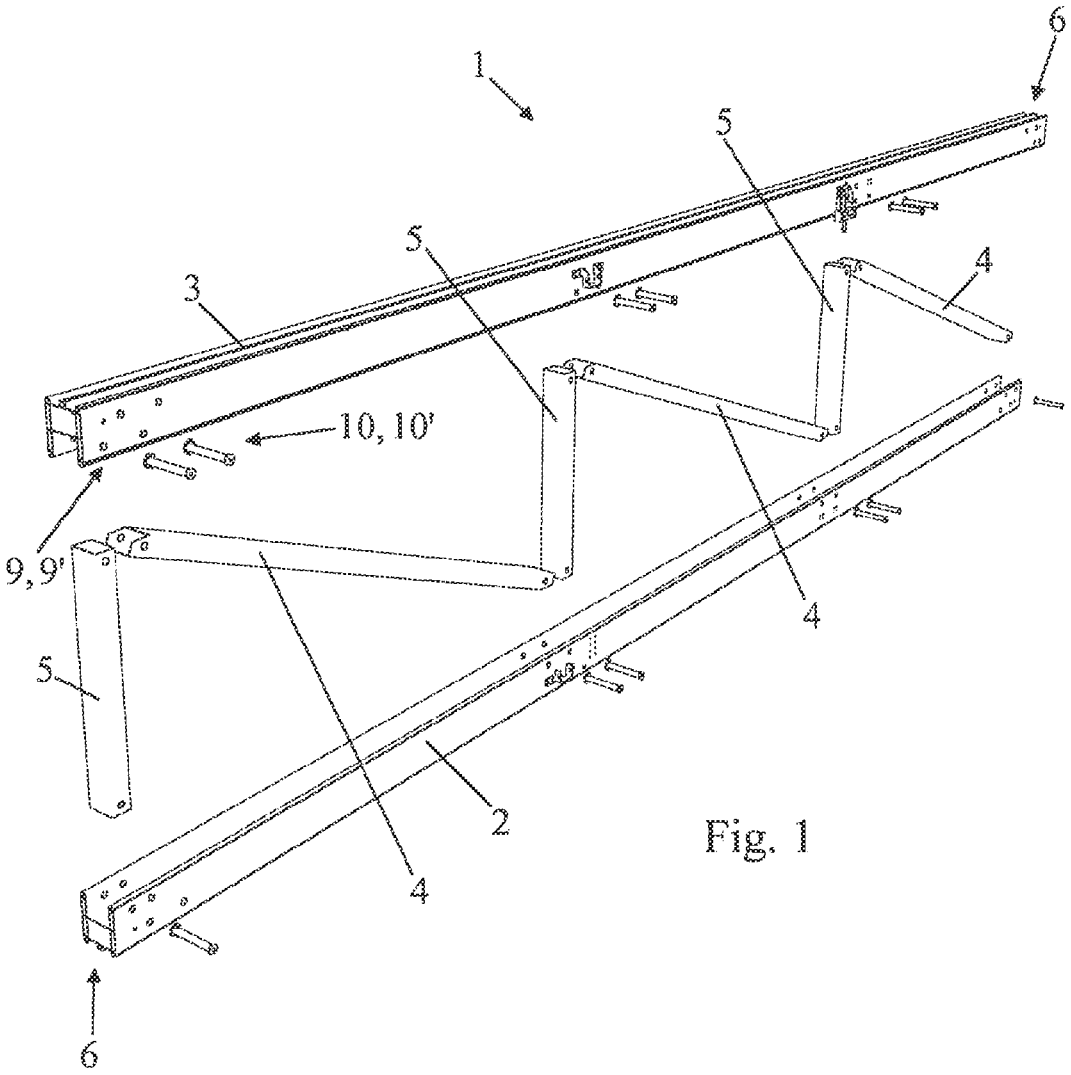
FIG. 1 is a perspective view of the lattice beam according to the invention.

According to the invention and as shown more particularly in FIG. 1 of the appended drawings, the preassembled lattice beam 1 for building a truss of a roof of a structure, in particular such as a tent or a stretched fabric structure, is characterized in that it is essentially made up of a lower rib 2 and an upper rib 3 connected to one another by at least one diagonal 4 secured to said lower 2 and upper 3 ribs so as to be able to pivot between the transport position, in which said lower 2 and upper 3 ribs are dose together, preferably in direct contact with one another, and a mounting position in which said lower 2 and upper 3 ribs are spaced apart from one another, preferably so as to form an acute angle, preferably of approximately 30°, between the at least one diagonal 4 and one of the two ribs 2, 3, and in that it has at least one stationary upright 5 connecting the lower 2 and upper 3 ribs at a right angle in said mounting position.

Figure 2:
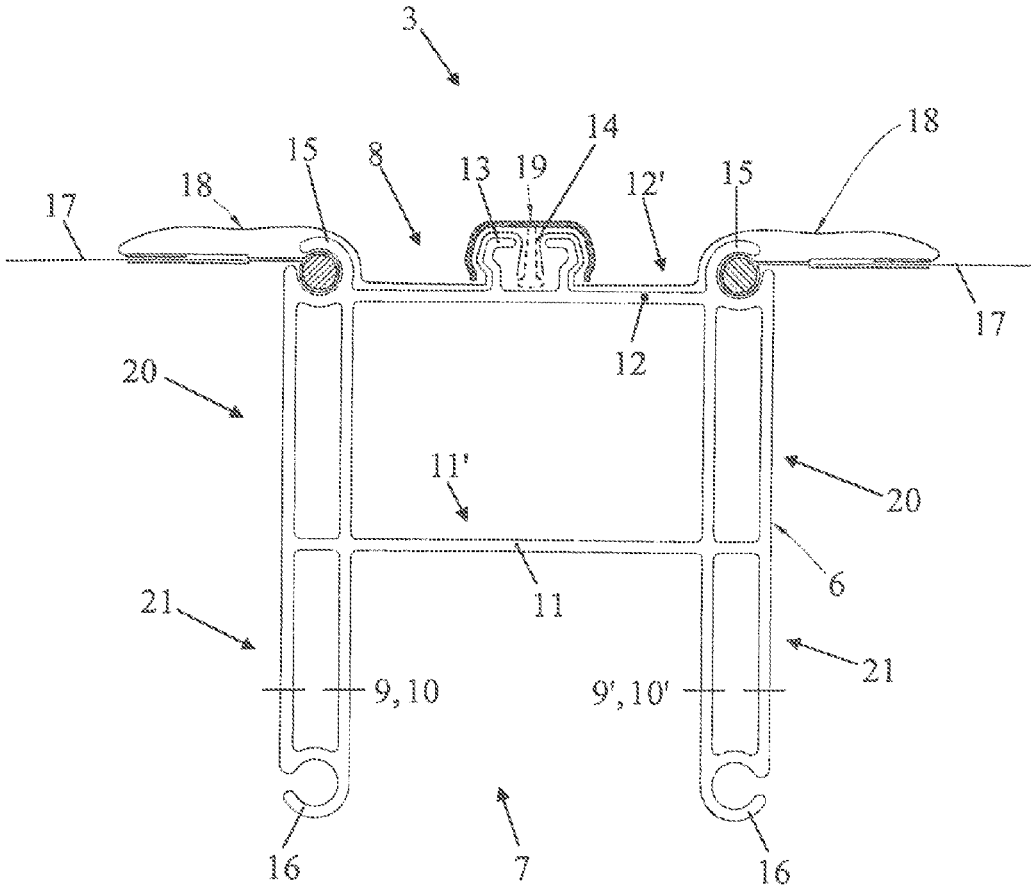
FIG. 2 is a cross-sectional side view, i.e. widthwise, of the profile of the rib of the preassembled lattice beam 1 of FIG. 1.

As seen more particularly in FIG. 2, the preassembled lattice beam 1 according to the invention is advantageously characterized in that at least one rib 2, 3 of said lower 2 and upper 3 ribs, preferably all of the ribs 2, 3, are each made in the form of an essentially H-shaped profile 6.

In this way, said essentially H-shaped profile 6 has an open side 7 receiving, on the inner surfaces of each side wing forming the feet of the H, at least one first pivoting fastening means 9, 9' of the pivoting diagonal(s) 4 and at least one second, rigid fastening means 10, 10' of the stationary upright(s) 5.

Furthermore, the profile 6 with the essentially H-shaped section has a dosed side 8 opposite the open side 7 and separated therefrom by at least one first crosspiece 11, preferably a first substantially flat and continuous partition wall 11' extending over the entire longitudinal length of said profile 6, the ends of each side wing forming the feet of the H on that side being connected by at least one second crosspiece 12, preferably a second substantially flat and continuous partition wall 12° extending over the entire longitudinal length of said profile 6.

Preferably, all of the essential structural elements (ribs, uprights, diagonals, etc.) are made from a sufficiently strong material such as steel or aluminum, the latter also having the advantage of having a comparatively lower density. Alloys and/or composite materials (in particular reinforced), for example mineral or synthetic fibers, can also be used traditionally and in a manner well known by those skilled in the art.

According to one additional feature, the preassembled lattice beam 1 according to the invention is characterized in that at least one end, preferably both ends of each side wing forming the feet of the H of the closed side 8 are provided with outer opening guides 15 for fastening the outer surface 17 of the roof.

Advantageously, said preassembled lattice beam 1 is also characterized in that at least one end, preferably both ends, of each side wing forming the feet of the H on the open side 7 are provided with inner opening guides 16 for fastening an inner suspended ceiling surface (not shown).

In this way, it is possible to fasten a single or double covering on the roof of the building to be made, the envelope being formed owing to the coverage by a synthetic membrane of the PVC-coated polyester or similar type, or using traditional insulated or non-insulated cladding panels. These types of guides, coverings, and their mechanical fastening devices are known in themselves and do not require further explanation.

Preferably, the profile 6 has a second crosspiece 12 formed as a second substantially flat and continuous partition wall 12', extending over the entire longitudinal length of said profile 6, the outer surface of said wall being provided with at least one rail or rail portion 13 extending over part or all of the longitudinal length of said profile 6, said rail or rail portion 13 being made in the form of a profile whereof the section has a shape capable of cooperating with an element of corresponding shape serving as fastening means situated on or provided for a sealing plate 18 ensuring sealing at the junction between the outer 15 and/or inner 16 opening guides and the outer roof surface 17 and/or inner suspended ceiling surface.

According to another feature, the catching means is a dip 19 capable of being attached on the rail or rail portion 13 by snapping through shape deformation (cf. FIG. 2).

According to one alternative suggested in broken lines in FIG. 2, the inner surface of the dip 19 facing the rail 13 can have one or more male lugs 14, for example in the shape of a mushroom whereof the head(s) oriented downward snap into the open female space formed by the geometric shape of the section of the rail to strengthen the attachment (for example, to make it inseparable without deterioration) of the clip 19, the sealing plate 18 with the profile 6.

In one particularly interesting embodiment, the preassembled lattice beam 1 according to the invention is characterized in that at least one through opening (not shown) is provided locally, preferably near the longitudinal ends of the preassembled lattice beam 1, in the first and second partition wall 11', 12', if applicable in the sealing plate 18 located at said opening, so as to discharge the rainwater that has accumulated on the outer surface 17 of the roof.

In this way, it is possible to provide a discharge for the collected rainwater owing to the slant of the outer surface 17 of the roof along drains formed at the second walls 12', the water for example ultimately being discharged through said openings and ad hoc channels provided in the posts 22 (cf. FIG. 4, toward the ground and gutters.

Preferably, at least the ends of each side wing forming the feet of the H on the closed side 8 are made in the form of a double wall or hollow double wing 20.

Likewise, it is also advantageously possible to provide that at least one of the ends of each side wing each of the H on the open side 7 is made in the form of a double wall or hollow double wing 21.

Of course, a single wall with a sufficient thickness is also possible for the aforementioned upper or lower wings.

According to another feature, the first pivoting fastening means 9, 9' and/or the second rigid fastening means 10, 10 are fastened on the inner walls or wings of the hollow double wall(s) 21 of the open side 7.

Any mechanical fastening means known by those skilled in the art can be used at this level, inasmuch as it enables fastening that either can be oriented by rotating the diagonals 4, which must pivot, and the uprights 5, which can be locked in their vertical position at 90° relative to the longitudinal horizontal axis of the ribs 2, 3, or due to the square ends of said uprights 5, which are blocked by said profile 6, or because of a rigid specific fastening means 10, 10 for said uprights 5 (welding, adhesion, screwing, etc.).

Unlike the uprights 5, the ends of the diagonals 4 are beveled so as not to hinder their pivoting movement, as suggested in FIGS. 3*a*, 3*b* during the folding/deployment of said ribs 2, 3, until the aforementioned uprights 5 are permanently inserted and fastened.

According to one particularly effective practical embodiment, the first pivoting fastening means 9, 9' and/or the second rigid fastening means 10, 10' are made up of an axle with a cylindrical section passing through the outer wall or wing of said double wall where it is retained, the inner wall or wing of said double wall, the end part of the diagonal 4 and/or the upright 5 to be connected, then the opposite inner wall or wing and the opposite outer wall or wing where it is also retained, all situated at the open side 7.

According to another alternative, said hollow double wall(s) 20, 21 of the closed 8 and/or open 7 side are filled with a material having isolating and/or stiffening properties.

Isolating materials in particular include all of the materials typically used for that purpose, such as thermal and/or sound insulators (synthetic foams, glass or rock wool, plant materials, etc.).

The present invention also relates to a roof truss for a structure such as a tent or a stretched fabric structure, characterized in that it comprises a plurality of preassembled lattice beams 1 according to the invention assembled to one another, in particular by pins.

Lastly, the present invention also relates to a tent or stretched fabric-type structure, characterized in that it comprises a truss according to the invention, placed and assembled on posts 22, in particular by pins, the assembly potentially being stabilized by brackets 23 assembled on said posts 22 and lattice.

Owing to the invention, it is possible to produce a disassemblable construction assembly such as a tent or stretched fabric structure for universal usage with a simple composition that is fast and easy to implement, which makes it possible to obtain large covered areas, with easy access, and the assembly or disassembly and transport of which are optimized.

The primary characteristics of a disassemblable configurable building as can be made using the elements of the present invention are:

1) good mechanical strength and compliance with the regulations in force, 2) ease and speed of assembly, 3) small bulk for transport, 4) adaptability to the insulation needs desired by the end user.

As shown in FIG. 4, the preassembled lattice beam 1 according to the invention can for example be made in the form of two different lengths 2L and 3L from a basic functional unit of length L comprising two uprights 5 and one diagonal 4. The modules thus formed with two diagonals 4 or three diagonals 4 are attached by pins traditionally at the junctions 24. Pinning also takes place at the points 25 to assemble the brackets 23 and the posts 22 to the preassembled lattice beams 1 according to the invention.

Of course, the invention is not limited to the embodiments described and shown in the appended drawings. Modifications remain possible, in particular in terms of the composition of the various elements or by substituting technical equivalents, without going beyond the scope of protection of the invention,

The invention claimed is:

1. A preassembled lattice beam for building a truss of a roof of a structure, in particular such as a tent or a stretched fabric structure, essentially made up of a lower rib and an upper rib connected to one another by at least one diagonal secured to said lower and upper ribs so as to be able to pivot between the transport position, in which said lower and upper ribs are close together, and a mounting position in which said lower and upper ribs are spaced apart from one another, preferably so as to form an acute angle, between the at least one diagonal and one of the two ribs, and having at least one stationary upright connecting in said mounting position at right angles to both the lower and upper ribs, at least one rib among the lower and upper ribs, each being made in the form of an essentially H-shaped profile having an open side receiving, on the inner surfaces of each side wing forming the feet of the H, at least one first pivoting fastening means of the pivoting diagonal(s) and at least one second, rigid fastening means of the stationary upright(s), characterized in that the profile with the essentially H-shaped section has a closed side opposite the open side and separated therefrom by at least one first crosspiece, extending over the entire longitudinal length of said profile, the ends of each side wing forming the feet of the H on that side being connected by at least one second crosspiece, extending over the entire longitudinal length of said profile.

2. The preassembled lattice beam according to claim 1, characterized in that at least one end, of each side wing forming the feet of the H of the closed side are provided with outer opening guides for fastening the outer surface of the roof.

3. The preassembled lattice beam according to claim 1, characterized in that at least one end, of each side wing forming the feet of the H on the open side are provided with inner opening guides for fastening an inner suspended ceiling surface.

4. The preassembled lattice beam according to claim 1, characterized in that the profile has a second crosspiece formed as a second substantially flat and continuous partition wall, extending over the entire longitudinal length of said profile, the outer surface of said wall being provided with at least one rail or rail portion extending over part or all of the longitudinal length of said profile, said rail or rail portion being made in the form of a profile whereof the section has a shape capable of cooperating with an element of corresponding shape serving as fastening means situated on or provided for a sealing plate ensuring sealing at the junction between the outer and/or inner opening guides and the outer roof surface and/or inner suspended ceiling surface.

5. The preassembled lattice beam according to claim 4, characterized in that the catching means is a clip capable of being attached on the rail or rail portion by snapping through shape deformation.

6. The preassembled lattice beam according to claim 1, characterized in that at least one through opening is provided locally, in the first and second partition wall, if applicable in the sealing plate located at said opening, so as to discharge the rainwater that has accumulated on the outer surface of the roof.

7. The preassembled lattice beam according to claim 1, characterized in that at least the ends of each side wing forming the feet of the H on the closed side are made in the form of a double wall or hollow double wing.

8. The preassembled lattice beam according to claim 7, characterized in that said hollow double wall(s) of the closed and/or open side are filled with a material having isolating and/or stiffening properties.

9. The preassembled lattice beam according to claim 1, characterized in that at least one of the ends of each side wing each of the H on the open side is made in the form of a double wall or hollow double wing.

10. The preassembled lattice beam according to claim 9, characterized in that the first pivoting fastening means and/or the second rigid fastening means are fastened on the inner walls or wings of the hollow double wall(s) of the open side.

11. The preassembled lattice beam according to claim 10, characterized in that the first pivoting fastening means and/or the second rigid fastening means are made up of an axle with a cylindrical section passing through the outer wall or wing of said double wall where it is retained, the inner wall or wing of said double wall, the end part of the diagonal and/or the upright to be connected, then the opposite inner wall or wing and the opposite outer wall or wing where it is also retained, all situated at the open side.

12. A roof truss for a structure such as a tent or a stretched fabric structure, characterized in that it comprises a plurality of preassembled lattice beams according to claim 1 assembled to one another, in particular by pins.

13. A tent or stretched fabric-type structure, characterized in that it comprises a truss according to claim 12, placed and assembled on posts, in particular by pins, the assembly potentially being stabilized by brackets assembled on said posts and lattice.

* * * * *